US005450167A

United States Patent [19]

Okano et al.

[11] Patent Number: 5,450,167

[45] Date of Patent: Sep. 12, 1995

[54] ELECTROPHOTOGRAPHIC IMAGE FORMING APPARATUS

[75] Inventors: Toshimasa Okano; Toshio Fukushima; Yuzuru Sugiura, all of Hyogo, Japan

[73] Assignee: Fujitsu Limited, Kawasaki, Japan

[21] Appl. No.: 199,663

[22] Filed: Feb. 22, 1994

[30] Foreign Application Priority Data

Feb. 26, 1993 [JP] Japan ..... 5-037792

[51] Int. Cl.[6] ..... G03G 15/00

[52] U.S. Cl. ..... 355/210; 355/200; 355/211

[58] Field of Search ..... 355/200, 210, 211, 212, 355/213, 260; 361/728, 733

[56] References Cited

U.S. PATENT DOCUMENTS

| | | | |
|---|---|---|---|
| 4,161,357 | 7/1979 | Herman et al. | 355/211 X |
| 4,367,036 | 1/1983 | Sakamaki et al. | 355/211 X |
| 4,659,206 | 4/1987 | Kaz et al. | 355/211 |
| 4,949,123 | 8/1990 | Takashima | 355/260 |
| 5,019,862 | 5/1991 | Nakamura et al. | 355/211 X |
| 5,130,751 | 7/1992 | Sato | 355/211 |
| 5,177,529 | 1/1993 | Schroll et al. | 355/200 |

*Primary Examiner*—A. T. Grimley
*Assistant Examiner*—Sandra L. Brasé
*Attorney, Agent, or Firm*—Armstrong, Westerman, Hattori, McLeland & Naughton

[57] ABSTRACT

An electrophotographic image forming apparatus in which overheating or burning of a heater caused by fabricating units whose specified supply voltages are different from each other is prevented. Power from a main unit is supplied to the heater, which is in a photosensitive drum in a drum unit, for heating the photosensitive drum so as to be maintained at a specified temperature, through a connecter disposed between the main unit and the drum unit. The connecter is comprised of parts which are respectively disposed in different positions, depending on the specified supply voltages. The respective positions of the parts vary, in relation to a reference position, in a direction around the rotation axis of the photosensitive drum which is rotated when the drum unit is installed in the main unit. When the specified supply voltage of the main unit is equal to that of the heater, the parts are fitted to each other, thereby making electrical connection.

15 Claims, 5 Drawing Sheets

ELECTROPHOTOGRAPHIC IMAGE FORMING APPARATUS

BACKGROUND OF THE INVENTION

1. Field of the Invention

The present invention relates generally to an electrophotographic image forming apparatus for use in a copying machine, printer, facsimile or the like and, more particularly, to an electrophotographic image forming apparatus in which power is supplied from a main unit to a heater for heating a photosensitive drum so as to be maintained at a specified temperature, provided in the photosensitive drum in a drum unit, through a connector disposed between the main unit and the drum unit.

2. Description of the Prior Art

In such an electrophotographic image forming apparatus, it is known to perform the following basic electrophotographic process in which reverse development is employed:

Firstly, the surface of a photosensitive drum is uniformly charged by a charger in a dark place. For exposure, light is then directed from an exposure device to an image portion formed on the surface of the photosensitive drum thus uniformly charged and the electrical charge on the illuminated image portion is eliminated to decrease the electric potential, thereby forming an electrostatic latent image having square well potential. Thereafter, toner, which is charged to the same polarity as that of the uniform charge applied to the surface of the photosensitive drum, is adhered to the electrostatic latent image by a developing device, utilizing an electric field formed by a developing bias, in order to form a visible toner image. A transfer sheet is subsequently overlaid on the toner image and electrical charge opposite in polarity to the charge of the toner is applied to the transfer sheet by a transferring device so that the toner image is transferred onto the transfer sheet owing to static electricity. The transfer sheet is further discharged by a discharging separator to reduce the electrostatic attraction force effecting on the photosensitive drum so that the transfer sheet is separated from the photosensitive drum. Thereafter, heat and/or pressure are applied by the fixing device to the toner image which has been transferred onto the transfer sheet so as to be fused to form a permanent image.

The surface of the photosensitive drum is provided with a photosensitive layer formed by vapor-depositing or coating a photoconductive material. As the photoconductive material, metals such as Se, CdS have been often used, but these metals are injurious to the human body and therefore cost a great deal for ensuring safety during the manufacturing process and waste disposal. In order to overcome the disadvantage, an organic photoconductor, amorphous silicon is widely used instead of these metals in recent years. The photosensitive drum having a photosensitive layer formed from amorphous silicon has been employed for use in electrophotographic image apparatus which are continuously used for a long period of time, because it has excellent surface hardness and a long service life. However, the charge intensity of such an amorphous silicon photosensitive layer when charged at room temperature is weak, so that the potential difference between an illuminated portion and a non-illuminated portion is not sufficient, which leads to the degradation of image quality.

One approach to solving the above problem inherent to a photosensitive drum having an amorphous silicon photosensitive layer has been provision of a heater within the photosensitive drum. This heater is supplied with power from a main unit through a connecter disposed between the main unit and a drum unit laving the photosensitive drum. By the use of the heater, the photosensitive drum is heated to and maintained at a specified temperature, and the charge intensity is thus improved.

SUMMARY OF THE INVENTION

In the case of such electrophotographic image forming apparatus, when manufacturing products with different specified supply voltages, for example, 100 volts a.c. and 200 volts a.c., only the circuit boards are designed differently in accordance with their respective specified supply voltage and other mechanical parts are common to all the products irrespective of the difference between specified supply voltages. This contributes to cost reduction, because the number of parts can be limited and assembling can be carried out in the same line.

A problem, however, arises in manufacturing electrophotographic image forming apparatus including a connecter as follows. Since voltage to be supplied to the heater from the main unit through the connecter disposed between the main unit and the drum unit is dependent on the specified supply voltage of the main unit, the drum unit to be installed in the main unit has to have a photosensitive drum with a heater whose specified supply voltage is equal to that of the main unit.

If two kinds of products with different specified supply voltages as mentioned above are assembled in the same production line, a drum unit sometimes happens to be installed in a main unit whose specified supply voltage is not equal to that of the heater included in the installed drum unit. Concretely, suppose a drum unit having a heater whose specified supply voltage is 200 volts is installed in a main unit whose specified supply voltage is 100 volts. In such a case, the amount of heat generated by the heater is insufficient, resulting in the degradation of image quality. On the contrary, when a drum unit having a heater whose specified supply voltage is 100 volts is installed in a main unit whose specified supply voltage is 200 volts, the heater will be overheated or burnt.

Bearing the foregoing problems in mind, the present invention aims to provide an electrophotographic image forming apparatus in which at least overheating or burning of a heater caused by installation of units with different specified supply voltages can be prevented.

The above and other objects can be achieved by an electrophotographic image forming apparatus according to the invention, wherein power is supplied from a main unit to a heater for heating a photosensitive drum so as to be maintained at a specified temperature, provided in the photosensitive drum in a drum unit, through a connecter disposed between the main unit and the drum unit; and wherein the connecter is electrically connectable only when the specified supply voltage of the main unit is equal to that of the heater.

The electrophotographic image forming apparatus is concretely embodied such that the connecter comprises parts which are respectively disposed in different positions depending on the specified supply voltage of the main unit and that of the heater, and which are fitted to each other to make electrical connection when these specified supply voltages are equal. The above mentioned different positions in which the parts of the connecter are disposed depending on the specified supply voltages are defined as:

1. positions which vary angularly in relation to a reference position located somewhere around the rotation axis, in a direction around the rotation axis of the photosensitive drum which is rotated when the drum unit is installed in the main unit;

2. positions which vary in a direction closer to or away from the rotation axis of the photosensitive drum which is rotated when the drum unit is installed in the main unit; or 3. positions which vary angularly in relation to a reference position located somewhere around the rotation axis, in a direction around the rotation axis of the photosensitive drum which is rotated when the drum unit is installed in the main unit, and which also vary in a direction closer to or away from the rotation axis.

The fitting of the parts of the connecter which is carried out when the specified supply voltage of the main unit is equal to that of the heater is established by installing the drum unit in the main unit. The installation of the drum unit in the main unit is achieved by fitting the drum unit on the main unit from one side of the photosensitive drum along the rotation angle of the photosensitive drum. The connecter comprises a socket and a plug as the above parts, and the socket may be provided in the main unit while the plug may be provided in the drum unit.

In another embodiment, the connecter comprises a socket and a plug either one of which is provided in the main unit and the other of which is provided in the drum unit; and at least the socket or plug which is provided in the main unit has, at different positions, terminals allocated to various specified supply voltages possible to be selected as the specified supply voltage of the main unit so that the number of terminals corresponds to the number of possible specified supply voltages; and when the specified supply voltage of the main unit is equal to that of the heater, the positions of the terminals of the socket and plug to which the specified supply voltages of the main unit and the heater respectively correspond are coincident with each other, so that electrical connection can be made. The coincidence of the terminal positions of the socket and plug which is achieved when the specified supply voltage of the main unit is equal to that of the heater means that the plug is snapped into the socket at the side to which the drum unit is installed with their terminals being connected to each other by fitting the drum unit on the main unit for installation from one side of the photosensitive drum along the rotation axis of the photosensitive drum. Thus, the terminal positions are coincided.

As has been described above, electrical connection cannot be made when the specified supply voltage of the main unit is not equal to that of the heater, and thus overheating or burning of the heater caused by installation of units whose specified supply voltages are different from each other can be positively prevented.

Other objects of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from tills detailed description.

BRIEF DESCRIPTION OF THE DRAWINGS

The present invention will become more fully understood from the detailed description given hereinbelow and accompanying drawings which are given by way of illustration only, and thus are not limitative of the present invention, and wherein:

FIG. 1 is a perspective view showing the principal part of the electrophotographic image forming apparatus immediately before installing a drum unit in a main unit;

FIG. 2 is a perspective view showing the principal part of the electrophotographic image forming apparatus with the drum unit being installed in the main unit;

FIG. 3 is a sectional view of the electrophotographic image forming apparatus with the drum unit being installed in the main unit;

FIG. 4(*a*) is a side view and FIG. 4(*b*)is a front view of a socket as being attached to a first connecter fixing flange and FIG. 4(*c*) is a side view and FIG. 4(*d*) is a front view of a plug as being attached to a second connecter fixing flange.

DESCRIPTION OF THE PREFERRED EMBODIMENTS

With reference to the drawings, preferred embodiments of an electrophotographic image forming apparatus according to the invention will be described hereinbelow.

Figure 1:
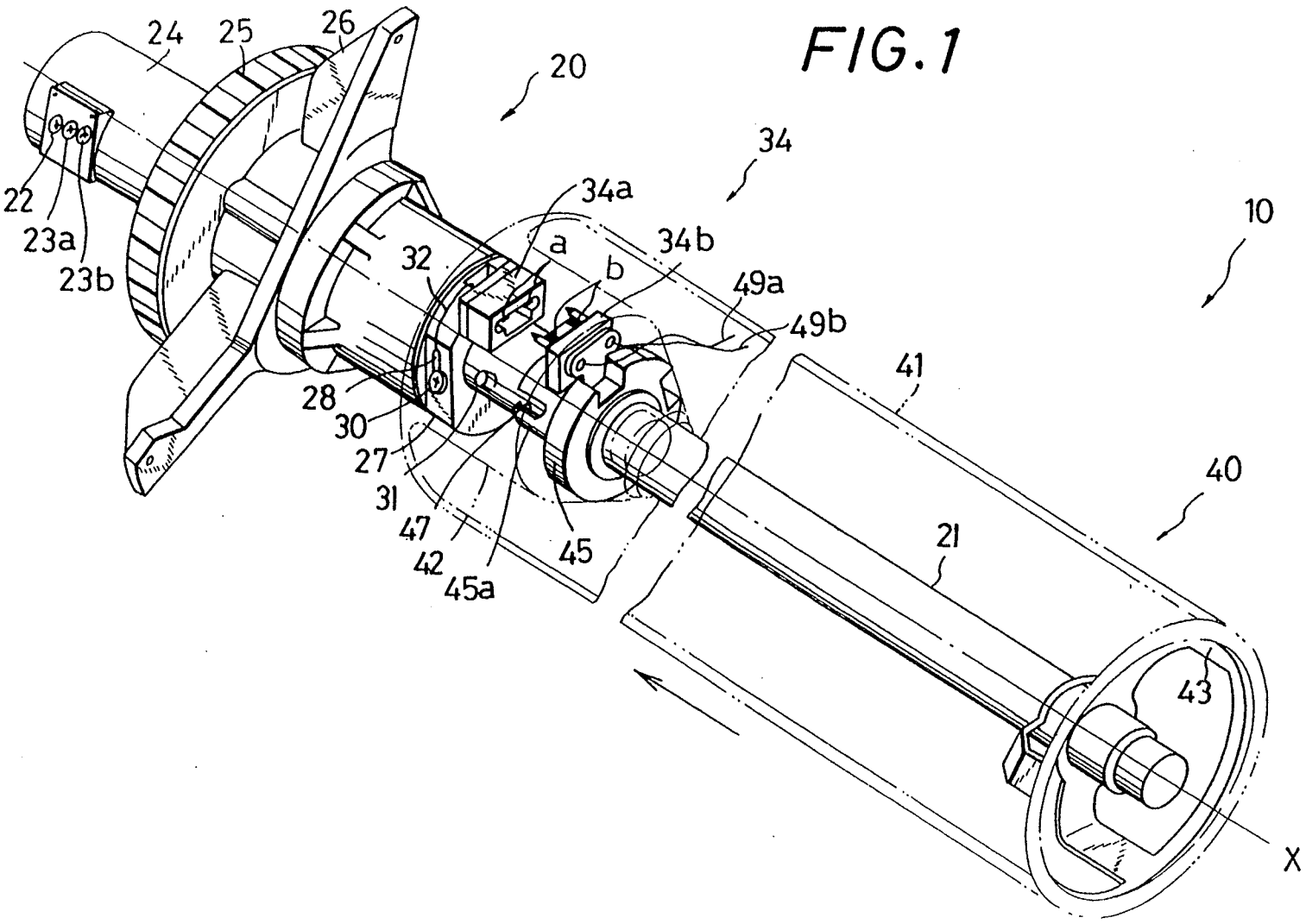
FIGS. 1 to 4 are for illustrating a preferred embodiment of an electrophotographic image forming apparatus according to the invention.
Figure 2:
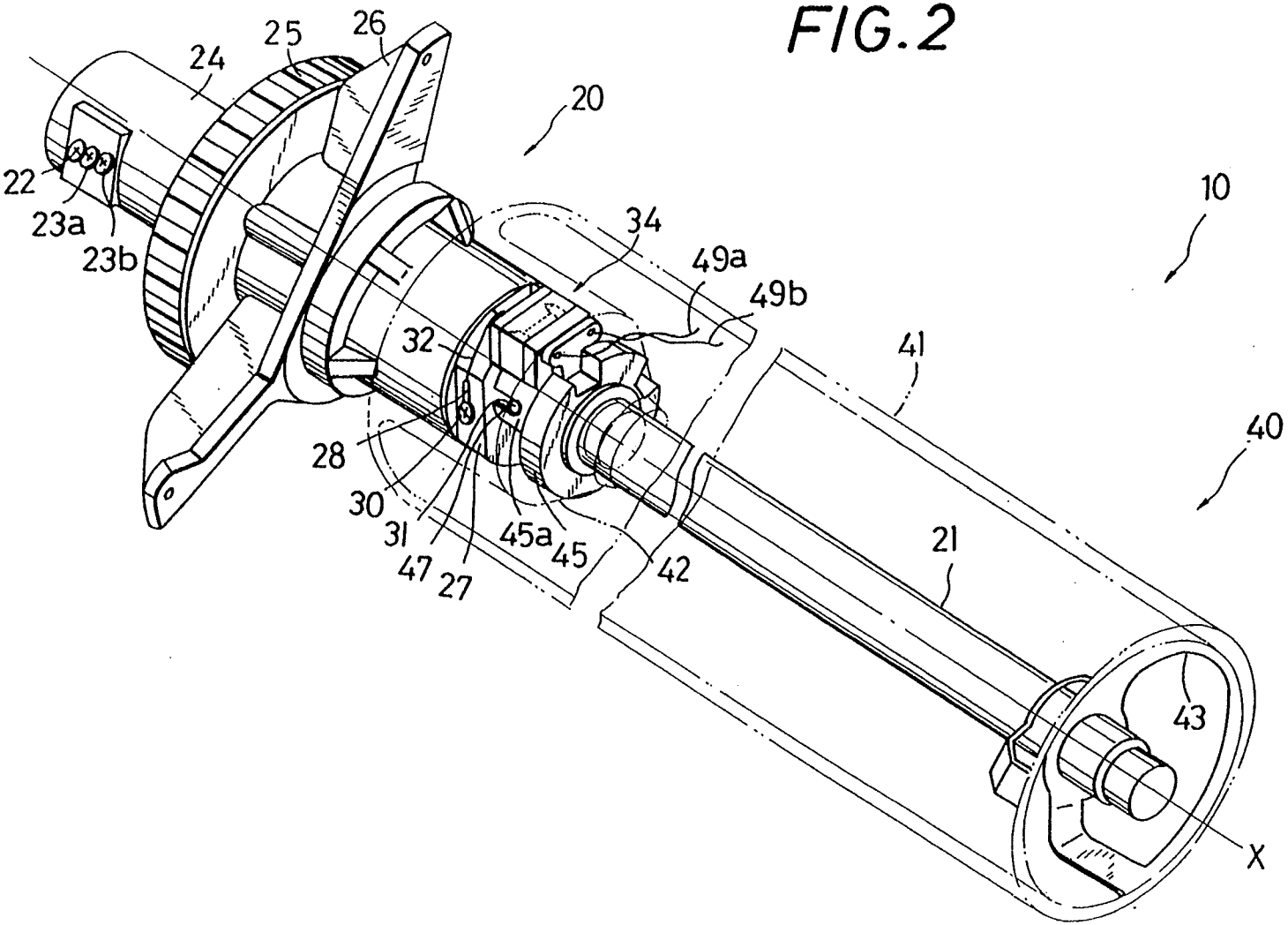
Figure 3:
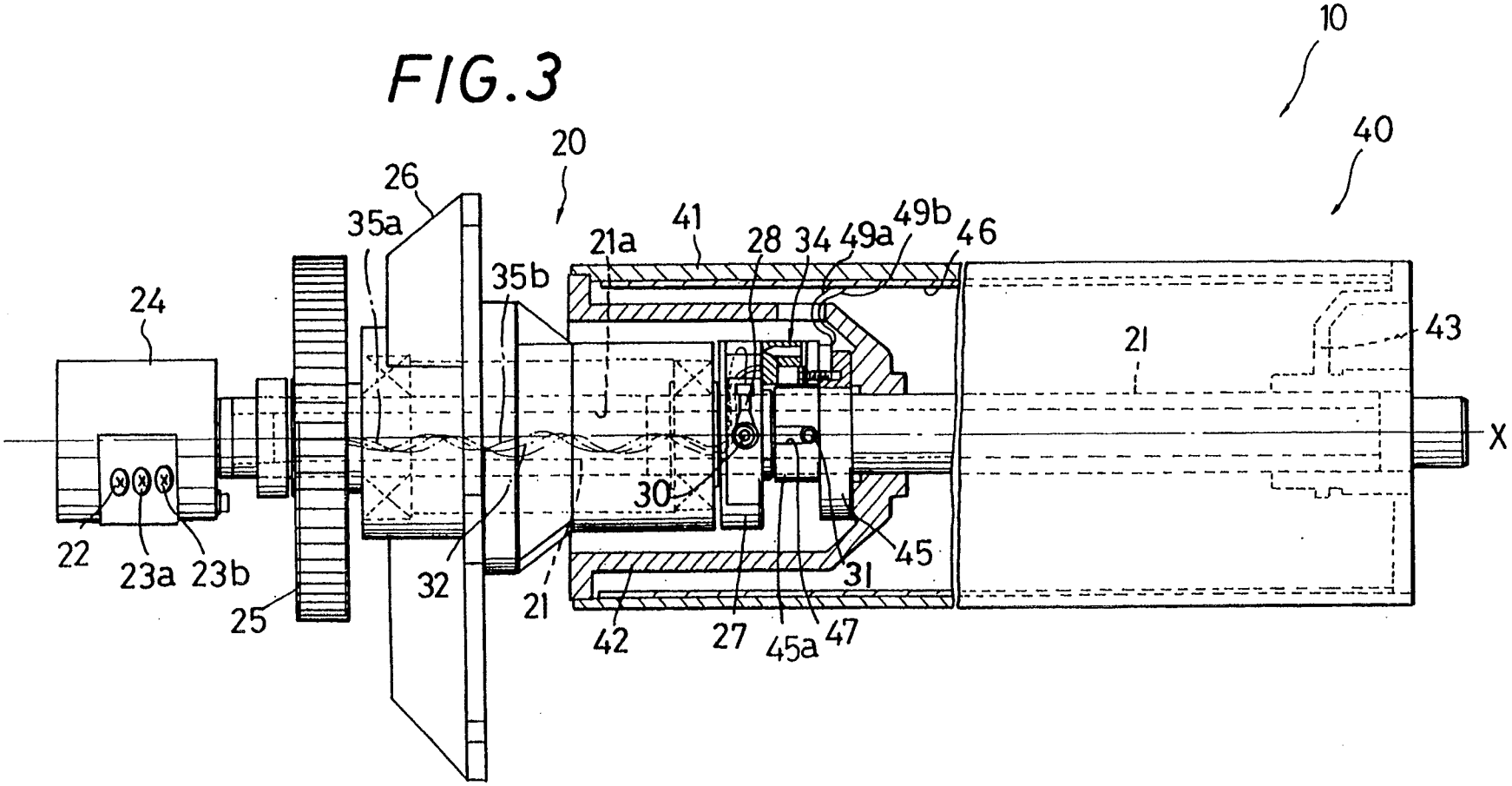
Figure 4A:
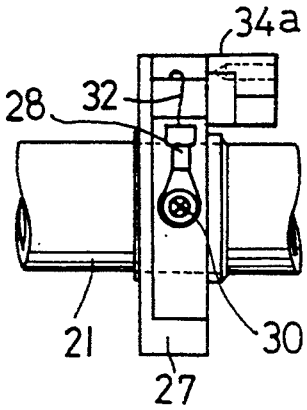
Figure 4B:
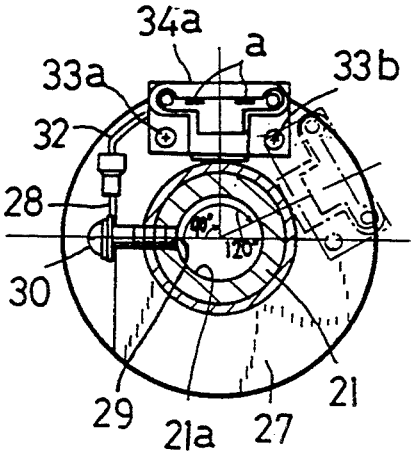
Figure 4C:
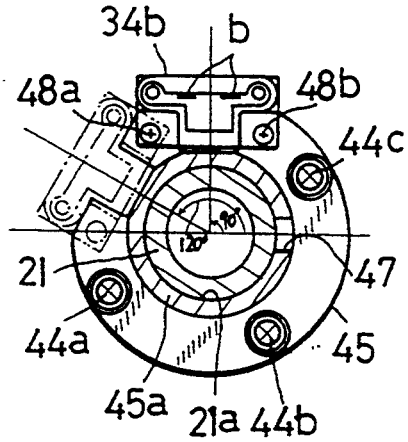
Figure 4D:
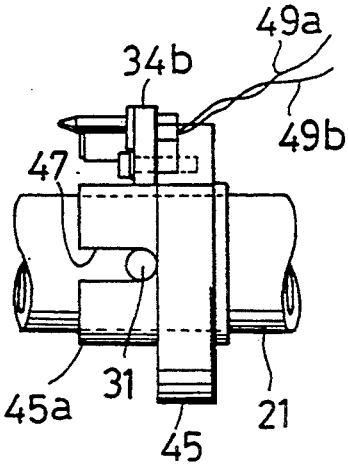

FIGS. 1 to 3 show an electrophotographic image forming apparatus 10 composed of a main unit 20 and a drum unit 40. The main unit 20 includes (i) a hollow drum shaft 21 that rotates about rotation axis X shown in the drawings; (ii) a slip ring 24 attached to one end of the drum shaft 21 for continuously, electrically connecting between the side of the drum shaft 21, the drum shaft 21 being rotated, and the side of a ground side terminal 22 and a pair of power source side terminals 23*a*, 23*b*, these terminals 22, 23*a*, 23*b* being stationarily attached; and (iii) a drum driving pulley 25, a drum shaft support 26 and a first connecter fixing flange 27 made from resin, these members 25, 26 and 27 being arranged in this order in a direction from one end of the drum shaft 21 to which the slip ring 24 is attached to the other. The drum driving pulley 25 is provided with, for example, a drum driving timing belt (not shown) wound around the pulley 25. The drum driving pulley 25 is attached to the drum shaft 21 such that it is unrotatable about the rotation axis X with respect to the drum shaft 21, and such that it allows the drum shaft 21 to rotate about the rotation axis X, receiving rotary driving force transmitted from a motor (not shown) through the drum driving timing belt. The drum shaft support 26 is attached to the main body of the equipment (not shown)

in which the image forming apparatus 10 is incorporated, in order to support the drum shaft 21 which is inserted through the drum shaft support 26 such that the drum shaft 21 pivots about the rotation axis X. The first connecter fixing flange 27 receives the drum shaft 21 that is inserted through the first connecter fixing flange 27, in a tight fashion. As shown in FIG. 4(*a*), the first connecter fixing flange 27 is attached to the drum shaft 21 at a specified position by means of a screw 30 so as not to be rotatable about the rotation axis X in relation to the drum shaft 21 and unmovable in a direction along the rotation axis X. The screw 30 pierces through a ground connection terminal 28 as well as through the first connecter fixing flange 27 to be threaded in a screw hole 29 which is defined in a prescribed position on the drum shaft 21. There is provided a positioning pin 31 projecting from a prescribed position on the periphery of the drum shaft 21.

The ground connection terminal 28 is electrically connected to one end of a ground side wire 32 that passes through a hollow portion 21*a* of the drum shaft 21. Since the screw 30 is made from a stainless steel, the drum shaft 21 is designed to be grounded through the ground side terminal 22, the slip ring 24, the ground side wire 32, the ground connection terminal 28 and the screw 30. A socket 34*a* of a connecter 34 is attached to the first connecter fixing flange 27 as shown in FIG. 4(*a*) by means of screws 33*a* and 33*b*. In this embodiment, the specified supply voltage of the main unit 20 is 100 volts a. c. and the socket 34*a* is located at a position 90 degrees shifted from a reference position (i.e., the position of the screw 30) in a clockwise direction, as indicated by a solid line. Similarly, the socket 34*a* is connected to the pair of power source side wires 35*a*, 35*b* arranged so as to pass through the hollow portion 21*a* of the drum shaft 21. With the above arrangement, 100 volts a.c., which is the specified supply voltage of the main unit 20, is thus supplied to the socket 34*a* through the power source side terminals 23*a*, 23*b*, the slip spring 24 and the power source side wires 35*a*, 35*b*.

The drum unit 40 includes (i) a photosensitive drum 41 in the form of a cylinder, which is made from aluminum and provided with a photosensitive layer made from amorphous silicon at the peripheral surface thereof; (ii) first and second drum flanges 42 and 43 which are secured to both ends of the photosensitive drum 41 and through which the drum shaft 21 is inserted in a tight fashion, one of them being made in the form of a cup while the other in the form of a fork; and (iii) a second connecter fixing flange 45 made from resin which is attached to the bottom of the first drum flange 42 with screws 44*a* to 44*c* as shown in FIG. 4(*b*) and through which the drum shaft 21 is tightly inserted.

A heater, such as a sheet-like heat generator 46, for heating the photosensitive drum 41 so as to be maintained at a specified temperature is attached to the drum 41 with the help of an adhesive or the like such that it spreads over the inner peripheral face of the photosensitive drum 41. The sheet-like heat generator 46 comprises a resistive element of a specified pattern formed on a heat resisting sheet. The second connecter fixing flange 45 has, at a sleeve 45*a* thereof, a positioning groove 47 in which the positioning pin 31 projecting from the drum shaft 21 is fitted. A plug 34*b* of the connecter 34 is attached to the second connecter fixing flange 45 with screws 48*a* and 48*b* as shown in FIG. 4(*b*). In this embodiment, the specified supply voltage of the sheet-like heat generator 46 is 100 volts a.c. and the plug 34*b* is therefore located in a position which is 90 degrees shifted counterclockwise from the reference position of the positioning groove 47 as indicated by a solid line in the drawing. The reference position of the positioning groove 47 is positioned corresponding to the reference position of the screw 30. A pair of power source side wires 49*a*, 49*b* are electrically connected to the plug 34*b* at one end thereof and to the sheet-like heat generator 46 at the other end thereof. By fitting the drum unit 40 on the main unit 20 from one side of the photosensitive drum 41 along the rotation axis X the direction of arrow in FIG. 1, the drum unit 40 can be installed, as shown in FIG. 2, in the main unit 20 such that the drum shaft 21 passes through the second connecter fixing flange 45 and the first and second drum flanges 42, 43 and such that the positioning pin 31 is fitted in the positioning groove 47. The plug 34*b* of the connecter 34 is fitted in the socket 34*a* so that a contact terminal a of the socket 34*a* is brought in contact with a contact terminal b of the plug 34*b* to make electrical connection, and 100 volts a.c. is supplied from the main unit 10 to the sheet-like heat generator 46 through the slip ring 24, the power source side wires 35*a*, 35*b*, the connecter 34 and the power source side wires 49*a*, 49*b*. The positioning pin 31 is fitted in the positioning groove 47 and the drum unit 40 is engaged with the drum shaft 21 so that the photosensitive drum 41 rotates about the rotation axis X concomitantly with the rotation of the drum shaft 21. The photosensitive drum 41 is grounded through the first and second drum flanges 42, 43, because these drum flanges 42, 43 are made from aluminum and the drum shaft 21 is made from a stainless steel and grounded as mentioned above.

Although it is not shown in the drawings, the sheet-like heat generator 46 is provided with a temperature detector such as a thermistor. Similarly to power supplying to the sheet-like heat generator 46, detection signals from the temperature detector are extracted through the connecter 34, a signal wire provided in the hollow portion 21*a* of the drum shaft 21 and the slip ring 24, in order to control power supplying to the sheet-like heat generator 46.

It is understood from the above description that, in this embodiment, the specified supply voltage of the main unit 20 is 100 volts a.c. and therefore the socket 34*a* of the connecter 34 is attached at the position indicated by a solid line in FIG. 4(*a*), while the specified supply voltage of the sheet-like heat generator 46 is 100 volts a.c. and therefore the plug 34*b* of the connecter 34 is attached at the position indicated by a solid line in FIG. 4(*b*). If the specified supply voltage of the main unit 20 is not 100 volts a.c. but 200 volts a.c. for example, the socket 34*a* of the connecter 34 is attached at the position indicated by a chain line in FIG. 4(*a*) which is 120 degrees shifted from the reference position of the screw 30 in a clockwise direction. If the specified supply voltage of the sheet-like heat generator 46 is 200 volts a.c., the plug 34*b* of the connecter 34 is attached at the position indicated by a chain line in FIG. 4(*b*) which is 120 degrees shifted from the reference position of the positioning groove 47 in a counterclockwise direction. The socket 34*a* and plug 34*b* of the connecter 34 are thus placed in relation to the reference position at different positions around the rotation axis X in accordance with the specified supply voltages.

If the specified supply voltage of the main unit 20 and that of the sheet-like heat generator 46 are the same, say, both 100 volts a.c. or both 200 volts a.c., the plug 34*b* will be snapped into the socket 34*a* when the drum unit 40 is installed in the main unit 20 by fitting the drum unit 40 on the main unit 20 from one side of the photosensitive drum 41 along the rotation axis X, and accordingly the contact terminal a comes in electrical contact with the contact terminal b. On the other hand, if the specified supply voltage of the main unit 20 differs from that of the sheet-like heat generator 46, for example, in the case that either one of them is 100 volts a.c. and the other is 200 volts a.c., the position of the socket 34*a* is not coincident with that of the plug 34*b* so that the plug 34*b* will not be fitted in the socket 34*a* and electrical connection will not be made. With this arrangement, if a wrong unit is installed by mistake during installation of the drum unit 40, it will be promptly found out. In consequence, even though most mechanical parts of the main unit 20 and the drum unit 40 except for the sheet-like heat generator 46 are common to products whose specified supply voltages are different from each other, such undesirable installation that the drum unit 40 is installed in the main unit 20 whose specified supply voltage is different from that of the installed drum unit 40 can be prevented.

In the foregoing embodiment, the sockets 34*a* and plug 34*b* of the connecter 34 are placed, in accordance with the specified supply voltages, in different positions around the rotation axis X in relation to the reference position located somewhere around the rotation axis X, but it is also possible that their positions may vary in a direction perpendicular to the rotation axis X, in other words, in a direction closer to or away from the rotation axis X. Further, their positions may vary in a direction around the rotation axis X in relation to the reference position located somewhere around the rotation axis X as well as in a direction closer to or away from the rotation axis X.

Although the invention has been described with the connecter 34 having the socket 34*a* provided at the main unit 20 and the plug 34*b* at the drum unit 40, the plug 34*b* may be arranged at the main unit 20 and the socket 34*a* may be at the drum unit 40.

Another embodiment of the electrophotographic image forming apparatus according to the invention will be described with reference to FIGS. 5(*a*) and 5(*b*), explaining points that are different from the foregoing embodiment. The same members as described in the foregoing embodiment will be indicated by the same reference numerals.

In this embodiment, a socket 34*a*′ and plug 34*b*′ of a connecter 34′ are attached to the first and second connecter fixing flanges 27, 45 respectively, and their positions do not vary according to the specified supply voltages. Provided on the side of a slip ring 24′ are a ground side terminal 22′ a pair of power source side terminals 23*a*′, 23*b*′ for a 100V a.c. power source and a pair of power source side terminals 23*c*′, 23*d*′ for a 200V a. c. power source. The socket 34*a*′ and plug 34*b*′ of the connecter 34′ in this embodiment have four contact terminals a′, a″ and b′, b″ respectively. These terminals may be allocated to different positions according to different specified supply voltages. Specifically, the contact terminals a′, b′ correspond to 100 volts a.c. and the contact terminals a″, b″ correspond to 200 volts a.c.

Figure 5B:
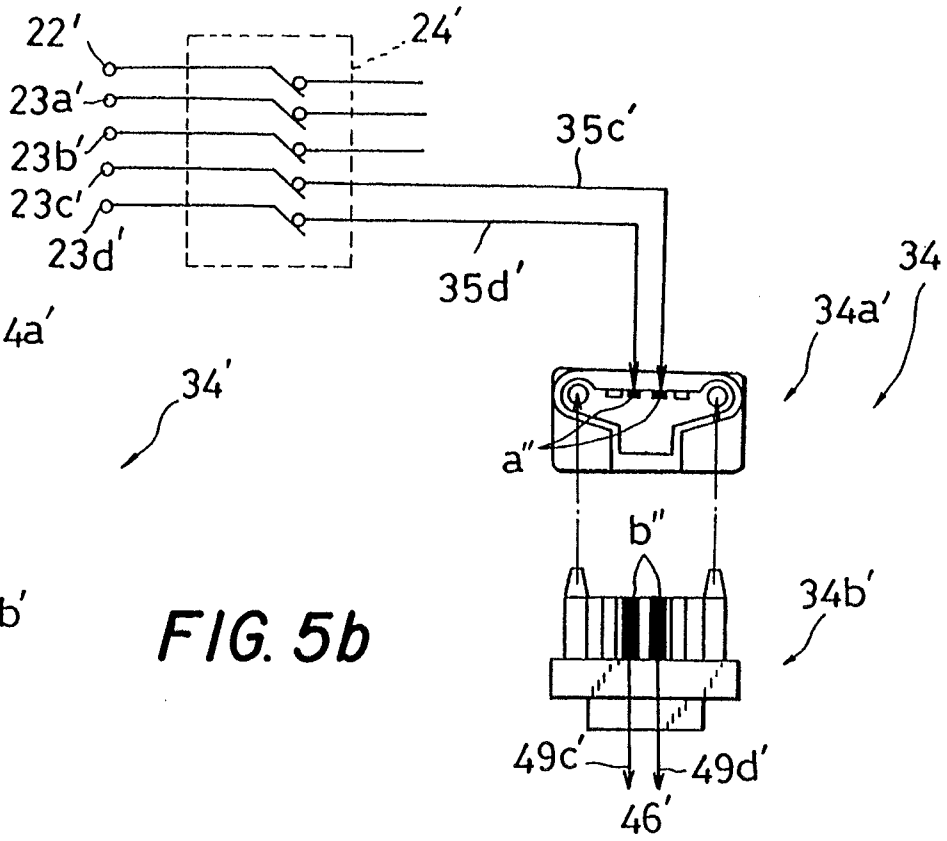
FIG. 5(*a*) is a front view of a socket and a side view of a plug, these socket and plug being included in a connecter according to another embodiment whose specified supply voltage is 100 volts a.c., and FIG. 5(*b*) is a front view of a socket and a side view of a plug, these socket and plug being included in a connecter according to the embodiment whose specified supply voltage is 200 volts a.c.
Figure 5A:
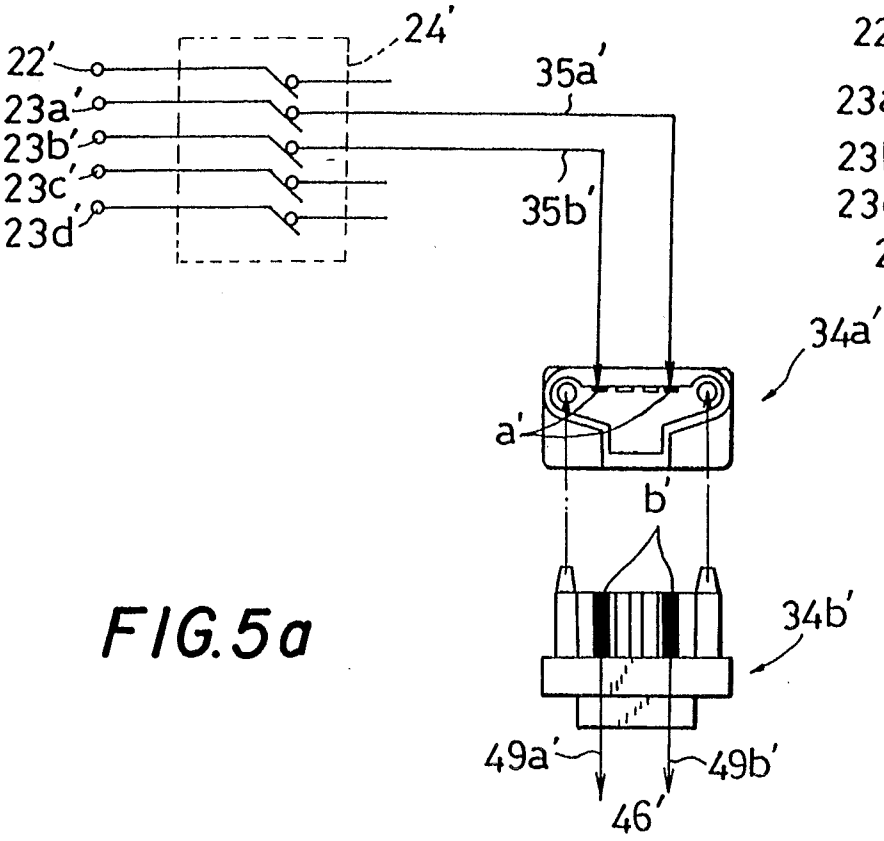

If the specified supply voltages of the main unit 20′ and the sheet-like heat generator 46′ are 100 volts a.c., 100 volts a.c. are supplied from the slip ring 24′ to the pair of contact terminals a′ located at the outer positions of the socket 34*a* through a pair of power source side wires 35*a*′, 35*b*′, as shown in FIG. 5(*a*). The pair of contact terminals b′ located at the outer positions of the plug 34*b*′ are electrically connected to the sheet-like heat generator 46′ through a pair of power source side wires 49*a*′, 49*b*′ as shown in the drawing.

On the other hand, when the specified supply voltages of the main unit 20′ and the sheet-like heat generator 46′ are 200 volts a.c., 200 volts a.c. are supplied from the slip ring 24′ to the pair of contact terminals a″ located at the inner positions of the socket 34*a*′ through another pair of power source side wires 35*c*′, 35*d*′, as shown in FIG. 5(*b*). The pair of contact terminals b″ located at the inner positions of the plug 34*b*′ are electrically connected to the sheet-like heat generator 46′ through a pair of power source side wires 49*c*′, 49*d*′ as shown in the drawing.

Since the socket 34*a*′ and the plug 34*b*′ are provided with contact terminals corresponding to different supply voltages (i.e., 100 volts a.c. and 200 volts a.c.) possibly specified for the main unit 20′ and the sheet-like generator 46′, if the specified supply voltage of the main unit 20′ is coincident with that of the sheet-like heat generator 46′ (i.e., both of their specified supply voltages are 100 volts a.c. or 200 volts a.c.), the corresponding contact terminals of the socket 34*a*′ and the plug 34*b*′ are connected when the drum unit 40′ is installed in the main unit 20′ by fitting the drum unit 40′ on the main unit 20′ from one side of the photosensitive drum 41″ along the rotation axis X, and thus electrical connection is made. On the other hand, if the specified supply voltages of the main unit 20′ and the sheet-like heat generator 46′ are not coincident with each other, the contact terminals of the socket 34*a*′ do not fit to those of the plug 34*b*′, so that no electrical connection is made and therefore the sheet-like heat generator 46′ does not generate heat. Similarly to the first embodiment, the plug 34*b*′ may be provided in the main unit 20′ and the socket 34*a*′ may be provided in the drum unit 40′ etc.

Obviously, the specified supply voltages of the main unit and the heat generator need not be 100 volts a.c. nor 200 volts a.c., as other comparable voltages can be used satisfactorily.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrophotographic image forming apparatus, wherein power, is supplied from a main unit to a heater for heating a photosensitive drum so as to be maintained at a specified temperature provided in the photosensitive drum in a drum unit, through a connecter disposed between the main unit and the drum unit; and wherein the connecter is electrically connectable only when the specified supply voltage of the main unit is equal to that of the heater.

2. The electrophotographic image forming apparatus as claimed in claim 1, wherein the connecter comprises parts which are respectively disposed in different positions depending on the specified supply voltage of the main unit and that of the heater, and which are fitted to each other to make electrical connection when these specified supply voltages are equal.

3. The electrophotographic image forming apparatus as claimed in claim 2, wherein said fitting established when the specified supply voltage of the main unit is equal to that of the heater is that, by fitting the drum unit on the main unit for installation from one side of the photosensitive drum along the rotation axis of the photosensitive drum, the parts of the connecter are fitted to each other at said side.

4. The electrophotographic image forming apparatus as claimed in claim 1, wherein the connecter comprises a socket arid a plug and the socket is provided in the main unit while the plug is provided in the drum unit.

5. The electrophotographic image forming apparatus as claimed in claim 4, wherein the socket is disposed in different positions depending on the specified supply voltage of the main unit while the plug is disposed in different positions depending on the specified supply voltage of the heater; and wherein the plug is fitted in the socket to make electrical connection when the specified supply voltage of the main unit is equal to that of the heater.

6. The electrophotographic image forming apparatus as claimed in claim 2 or 5, wherein said different positions depending on the specified supply voltages are positions which vary angularly in relation to a reference position located somewhere around the rotation axis, in a direction around the rotation axis of the photosensitive drum which is rotated when the drum unit is installed in the main unit.

7. The electrophotographic image forming apparatus as claimed in claim 2 or 5, wherein said different positions depending on the specified supply voltages are positions which vary in a direction closer to or away from the rotation axis of the photosensitive drum which is rotated when the drum unit is installed in the main unit.

8. The electrophotographic image forming apparatus as claimed in claim 2 or 5, wherein said different positions depending on the specified supply voltages are positions which vary angularly in relation to a reference position located somewhere around the rotation axis, in a direction around the rotation axis of the photosensitive drum which is rotated when the drum unit is installed in the main unit, and which also vary in a direction closer to or away from the rotation axis.

9. The electrophotographic image forming apparatus as claimed in claim 2 or 5, wherein said fitting carried out when the specified supply voltage of the main unit is equal to that of the heater is established by installing the drum unit in the main unit.

10. The electrophotographic image forming apparatus as claimed in claim 9, wherein said installation of the drum unit in the main unit is achieved by fitting the drum unit on the main unit from one side of the photosensitive drum along the rotation angle of the photosensitive drum.

11. The electrophotographic image forming apparatus as claimed in claim 5, wherein said fitting established when the specified supply voltage of the main unit is equal to that of the heater is that, by fitting the drum unit on the main unit for installation from one side of the photosensitive drum along the rotation axis of the photosensitive drum, the plug is snapped into the socket at said side.

12. The electrophotographic image forming apparatus as claimed in claim 1, wherein the connecter comprises a socket and a plug either one of which is provided in the main unit and the other of which is provided in the drum unit;

wherein at least the socket or plug which is provided in the main unit has, at different positions, terminals allocated to various specified supply voltages possible to be selected as the specified supply voltage of the main unit so that the number of terminals corresponds to the number of possible specified supply voltages; and wherein when the specified supply voltage of the main unit is equal to that of the heater, the positions of the terminals of the socket and plug which the specified supply voltages of the main unit and the heater respectively correspond are coincident with each other, so that electrical connection can be made.

13. The electrophotographic image forming apparatus as claimed in claim 12, wherein said coincidence of the terminal positions of the socket and plug achieved when the specified supply voltage of the main unit is equal to that of the heater is that, by fitting the drum unit on the main unit for installation from one side of the photosensitive drum along the rotation axis of the photosensitive drum, the plug is snapped into the socket at said side with their terminals being connected to each other.

14. The electrophotographic image forming apparatus as claimed in claim 1, wherein the heater is a sheet-like heat generator disposed so as to spread over the inner peripheral face of the photosensitive drum.

15. The electrophotographic image forming apparatus as claimed in claims 1 to 5 and 3 to 14, wherein the photosensitive drum has a photosensitive layer on its outer peripheral face and the photosensitive layer is made from amorphous silicon.

* * * * *